US006082006A

United States Patent [19]

Cahan

[11] Patent Number: 6,082,006

[45] Date of Patent: Jul. 4, 2000

[54] COLLAPSIBLE SHAVING IMPLEMENT

[75] Inventor: Leslie A. Cahan, Phoenix, Ariz.

[73] Assignee: Concept Devices LLC, Zephyr Cove, Nev.

[21] Appl. No.: 09/090,606

[22] Filed: Jun. 4, 1998

Related U.S. Application Data

[60] Provisional application No. 60/049,917, Jun. 18, 1997.

[51] Int. Cl.[7] ..... B26B 21/00

[52] U.S. Cl. ..... 30/47; 30/532

[58] Field of Search ..... 30/32, 47, 526, 30/532

[56] References Cited

U.S. PATENT DOCUMENTS

| | | | |
|---|---|---|---|
| 3,750,280 | 8/1973 | LaPaliscot et al. | 30/47 |
| 4,439,920 | 4/1984 | Nauheimer | 30/47 |
| 4,546,544 | 10/1985 | Kiraly et al. | 30/47 |
| 4,554,735 | 11/1985 | Chen | 30/47 |
| 4,712,301 | 12/1987 | Saito | 30/47 |
| 4,985,994 | 1/1991 | Tavolieri | 30/47 |
| 5,027,510 | 7/1991 | Bodtke | 30/47 |

*Primary Examiner*—Hwei-Siu Payer
*Attorney, Agent, or Firm*—Parsons & Goltry; Robert A. Parsons; Michael W. Goltry

[57] ABSTRACT

An implement comprising a body and a blade carried by the body and engagable for movement against a surface for effecting removal of hair, the body foldable between an operative orientation in a form of a handled body with the blade exposed for engagement against a surface, an extended orientation and a collapsed in a form of a receptacle with the blade contained therein, a first engagement assembly for securing the body in the collapsed orientation and a second engagement assembly for securing the body in the operative orientation.

13 Claims, 3 Drawing Sheets

FIG. 1
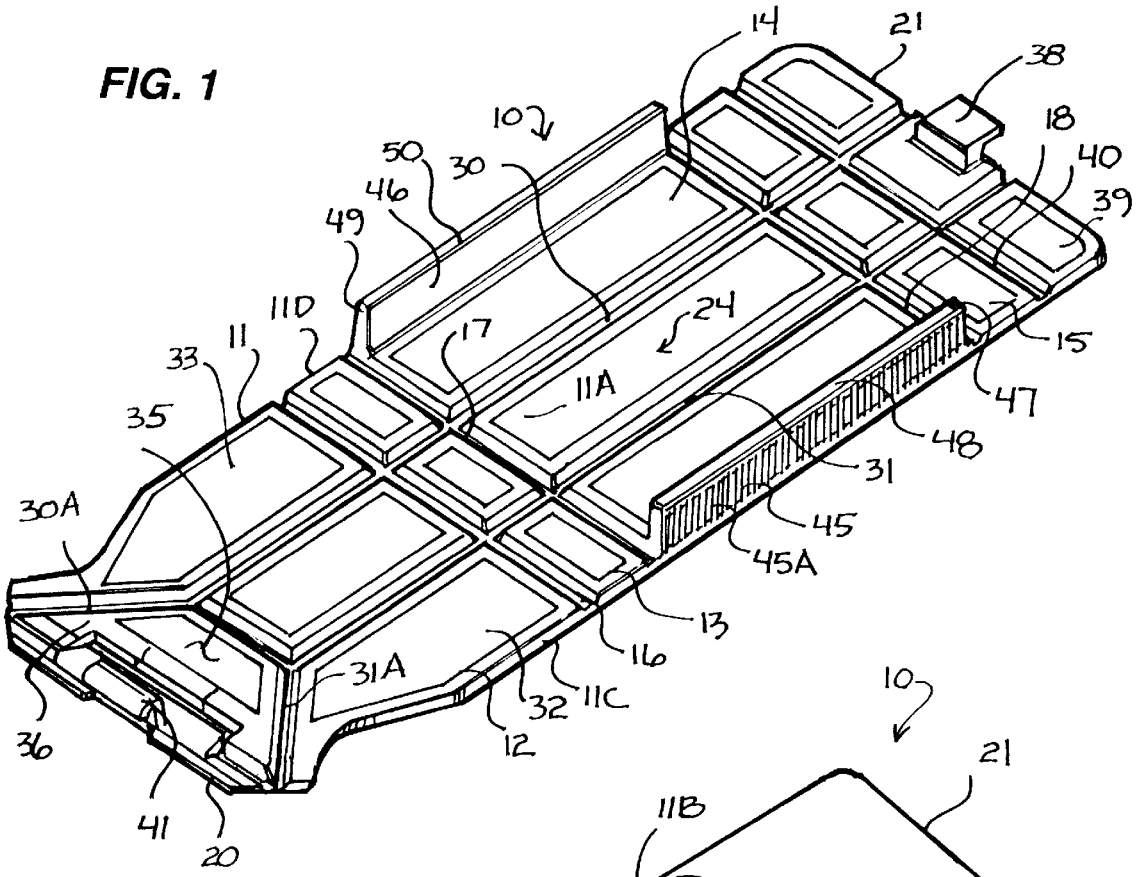
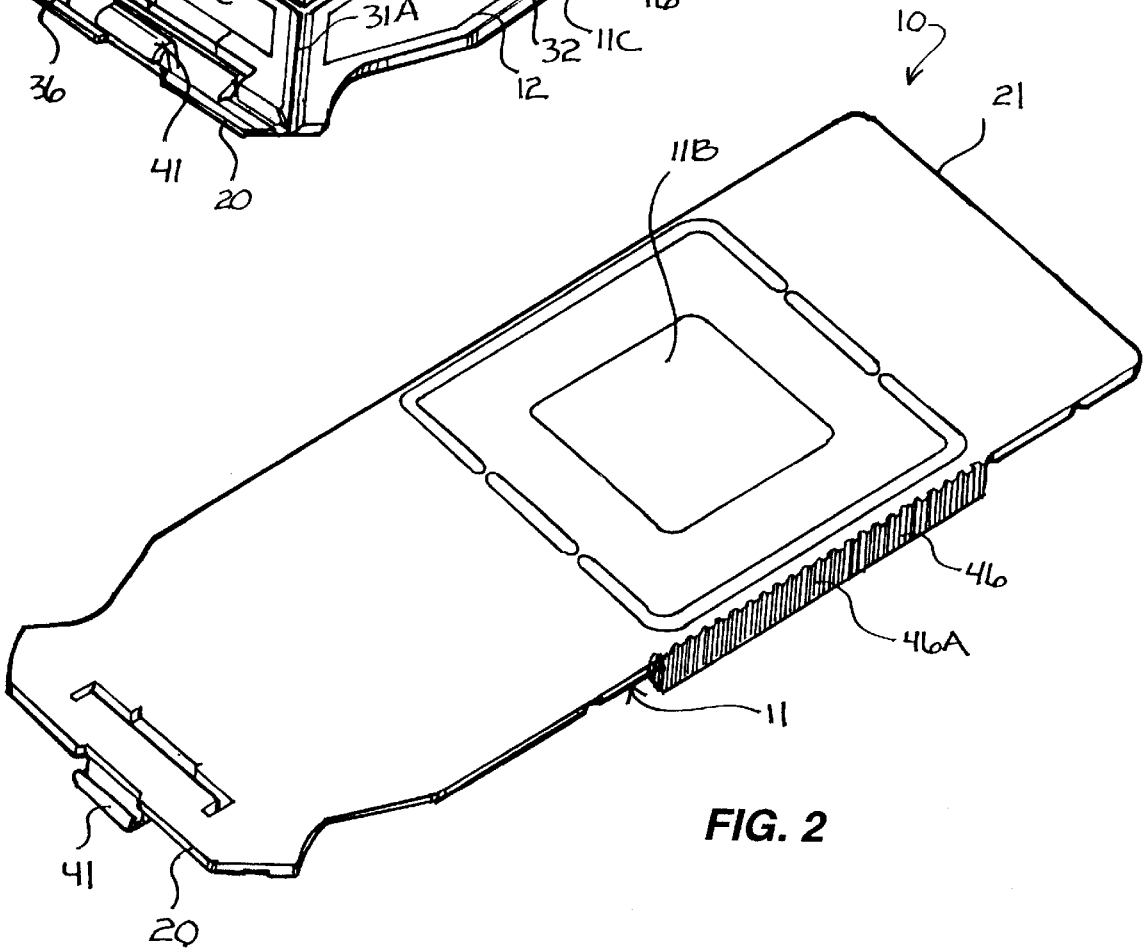
FIG. 2

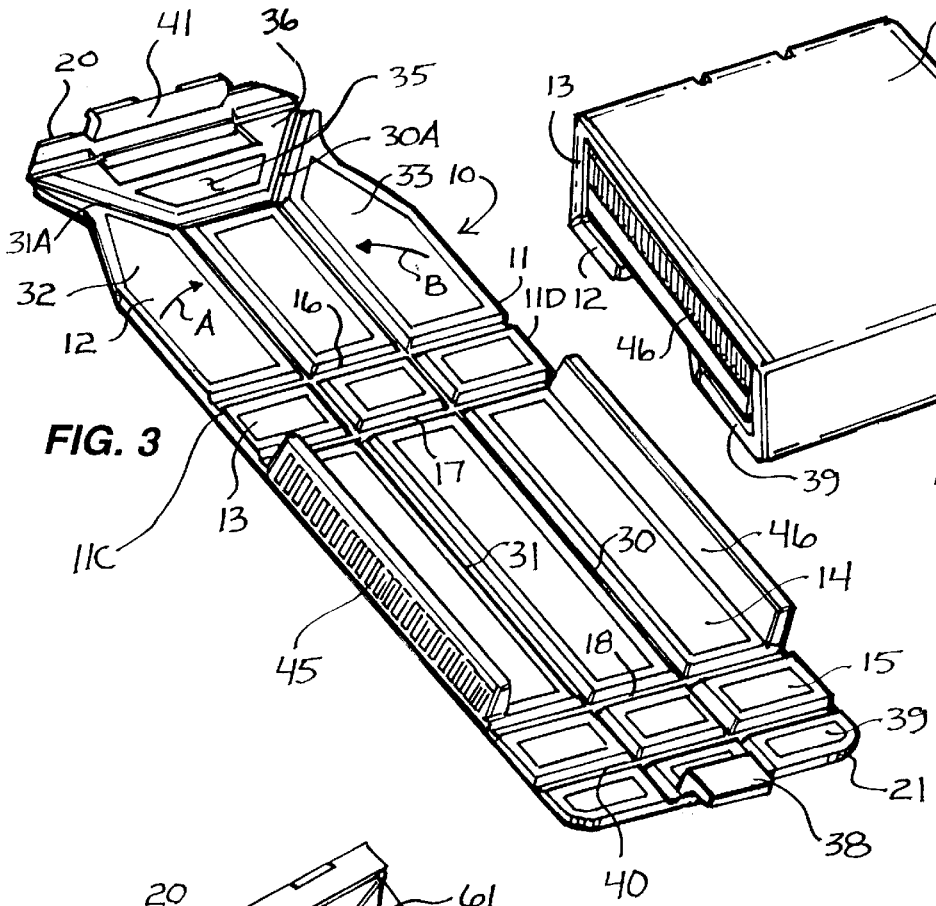
FIG. 3
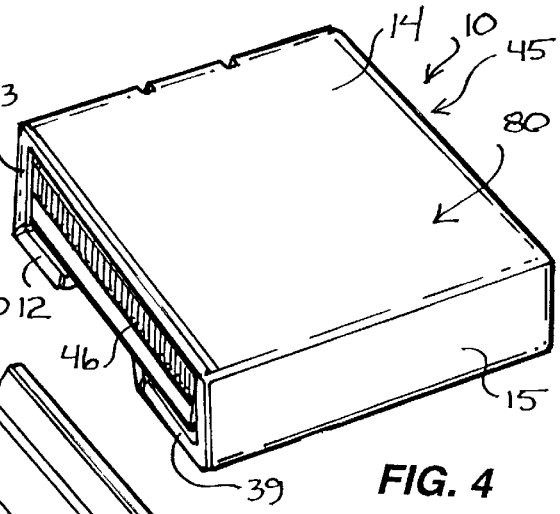
FIG. 4
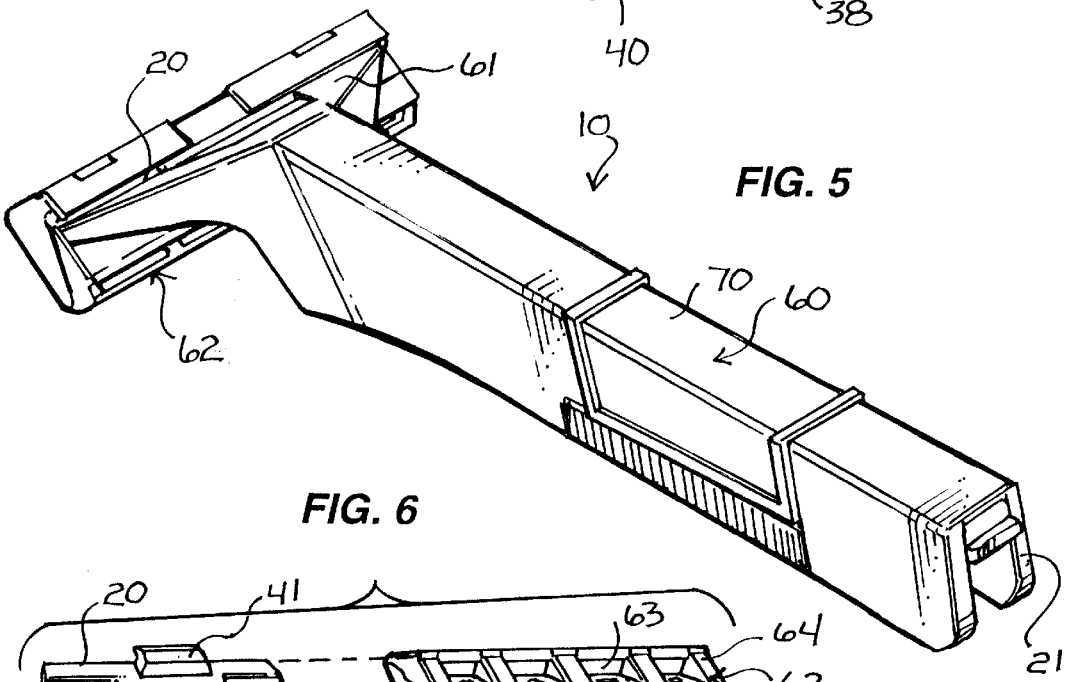
FIG. 5
FIG. 6
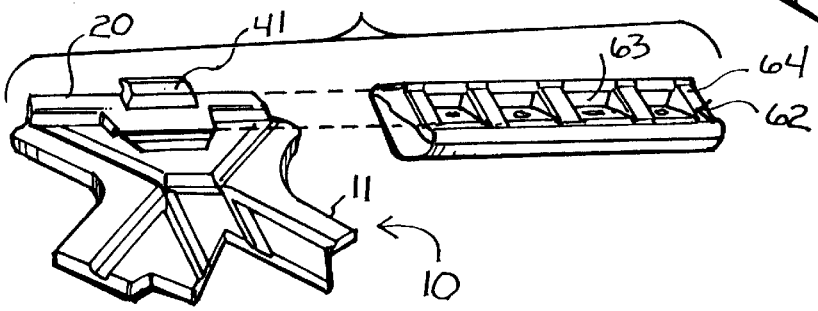

COLLAPSIBLE SHAVING IMPLEMENT

This application claims the benefit of U.S. Provisional Application 60/049,917, filed Jun. 14, 1997.

FIELD OF THE INVENTION

This invention relates generally to the field of implements and, more particularly, to improved collapsible shaving implements.

BACKGROUND OF THE INVENTION

The prior art is replete with various forms of shaving implements and, more particularly, collapsible shaving implements. The advent of collapsible shaving implements has been driven primarily by a long-felt need of providing users with a convenient means for not only effecting shaving, but also for storing a shaving implement for transport or travel. Although exemplary, the prior art collapsible shaving implements continue to suffer from structural shortcomings that not only impede collapsibility and storage, but also limit comfortable shaving activity.

Accordingly, it would be highly desirable to provide a new and improved collapsible shaving implement.

It is a purpose of the present invention to provide a new and improved collapsible shaving implement that is easy to construct.

It is another purpose of the present invention to provide a new and improved collapsible shaving implement that is inexpensive.

It is still another purpose of the present invention to provide a new and improved collapsible shaving implement that is easy to use.

It is a further purpose of the present invention to provide a new and improved collapsible shaving implement that in a collapsed orientation, may be used for storing one or more blade cartridges.

It is still a further provision of the present invention to increase the functional utility of collapsible shaving implements.

SUMMARY OF THE INVENTION

The above problems and others are at least partially solved and the above purposes and others are realized in a new and improved shaving implement comprising a body including a hinge extending substantially from a first extremity of the body to a second extremity of the body, and a plurality of transverse hinges positioned at spaced intervals intermediate the first and second extremities, each of the plurality of transverse hinges extending substantially from a first lateral extremity of the body to a second lateral extremity of the body. Further included is a blade of a type carried by a framework together cooperating as a blade cartridge, the blade engagable for movement against a surface for effecting removal of hair.

The body of the shaving implement is foldable at the hinge between an operative orientation in a form of a handled body with the blade exposed for engagement against a surface, and an extended orientation of the body. The body of the shaving implement is also foldable at the plurality of transverse hinges between a collapsed orientation of the body in a form of a receptacle, and the extended orientation of the body. The present invention further includes first means for securing the body in the collapsed orientation, and second means for securing the body in the operative orientation.

In an exemplary embodiment, the hinge may comprise spaced-apart first and second living hinges extending substantially from the first extremity to the second extremity, and each one of the plurality of transverse hinges may comprise a living hinge. The first means for securing the body in the collapsed orientation may generally comprise an engagement an engagement element carried proximate one of the first and second extremities, and a detachably engagable complemental engagement element carried proximate the other one of the first and second extremities. In a particular embodiment, the engagement element may include a hook and the complemental engagement element includes a loop.

The second means for securing the body in the operative orientation may generally comprise at least one engagement element carried proximate one of the first and second lateral extremities, and at least one detachably engagable complemental engagement element carried proximate the other one of the first and second lateral extremities. In a particular embodiment, the engagement element comprising an element of the second means may include one of a tongue and a pin, and the complemental engagement element comprising another element of the second means may include one of a groove and a socket, respectively.

The plurality of living hinges divide the body into a plurality of base sections and a plurality of side sections. In this regard, the receptacle of the invention comprising the collapsed orientation of the body may include the plurality of base sections and the plurality of side sections cooperating together to form a substantially box-like receptacle, of which, in an exemplary embodiment, may be closed bounding a chamber within which, for instance, one or more items may be stored.

The hinge of the present invention may include opposing hinge portions located adjacent and diverging toward the first extremity wherein one of the plurality of transverse hinges, each of the opposing hinge portions and portions of the hinge intermediate the opposing hinge portions and the one of the plurality of transverse hinges cooperate to define opposing trusses. Upon folding movement of the body into the operative orientation, the opposing trusses exhibit a flexing tension to orient and maintain the blade in a substantially angled orientation relative the handled body for engagement and movement against a surface for effecting removal of hair.

BRIEF DESCRIPTION OF THE DRAWINGS

The foregoing and further and more specific objects and advantages of the instant invention will become readily apparent to those skilled in the art from the following detailed description thereof taken in conjunction with the drawings in which:

FIG. 1 is a top perspective view of an implement, in accordance with the present invention;

FIG. 2 is a bottom perspective view of the implement of FIG. 1;

FIG. 3 is a view very similar to the view of FIG. 1;

FIG. 4 is a perspective view of the implement of FIG. 1 shown as it would appear in a collapsed orientation;

FIG. 5 is a perspective view of the implement of FIG. 1 shown as it would appear in an operative orientation;

FIG. 6 is a fragmented perspective view of a head of the implement of FIG. 1 and a blade cartridge shown spaced from the head;

DETAILED DESCRIPTION OF A PREFERRED EMBODIMENT

Figure 7:
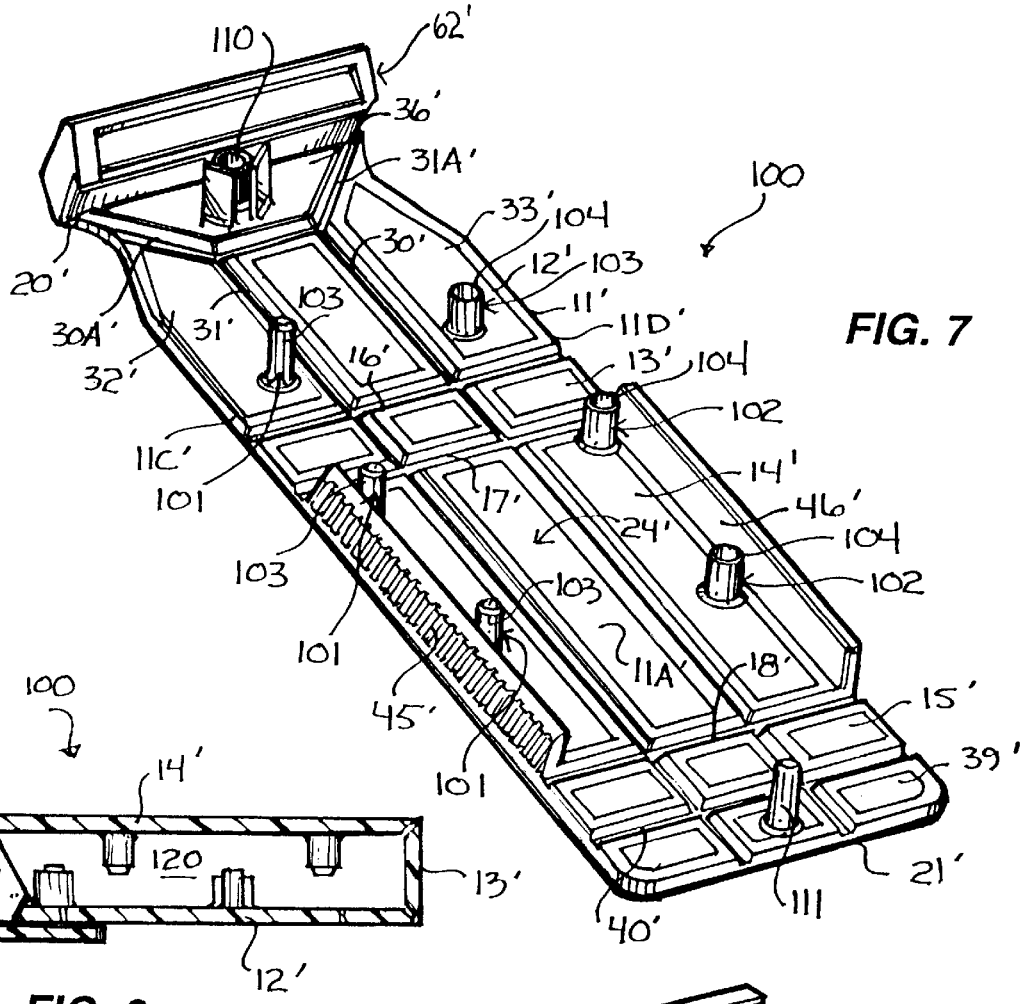
FIG. 7 is a perspective view of an implement, in accordance with an alternate embodiment of the invention.

The present invention provides, among other things, a collapsible shaving implement foldable between an operative orientation for effecting engagement of a blade for movement against a surface for effecting hair removal and a collapsed orientation for storage or transport. The present invention is easy to construct, easy to use and is highly efficient.

Turning now to the drawings, in which like reference characters indicate corresponding elements throughout the several views, attention is first directed to FIG. 1 illustrating a top perspective view of an implement generally designated by the reference character 10, in accordance with the present invention. Implement 10 comprises a body 11 preferably constructed of molded polypropylene or other suitable form of synthetic plastic material. Body 11 includes an inner surface 11A and an outer surface 11B as shown substantially in FIG. 2 illustrating a bottom perspective view of implement 10. Body 11 further includes first and second extremities 20 and 21, first and second lateral extremities 11C and 11D, a hinge generally designated at 24 extending substantially from first extremity 20 to second extremity and a plurality of transverse hinges 16, 17 and 18 aligned in series and positioned at spaced intervals intermediate first and second extremities 20 and 21. Each of the plurality of transverse hinges 16, 17 and 18 extend substantially from first lateral extremity 11C to second lateral extremity 11D. Transverse hinges 16, 17 and 18, of which preferably comprise living hinges, divide body 11 into a plurality of spaced-apart sections including first and second base sections 12 and 14 and first and second side sections 13 and 15. As shown in FIG. 1, first base section 12, first side section 13, second base section 14 and second side section 15 align in series from first extremity 20 to second extremity 21.

In the embodiment shown in FIG. 1, hinge 24 generally comprises spaced-apart first and second hinges 30 and 31 extending substantially from first extremity 20 to second extremity 21. Each preferably comprised of a living hinge, first and second hinges 30 and 31 intersect hinges 16, 17 and 18 and include spaced-apart and substantially opposing hinge portions 30A and 31A diverging outwardly toward first extremity 20 of body 11 at a point intermediate living hinge 16 and first extremity 20. As clearly shown in FIG. 1, hinge 16, each opposing hinged portion 30A and 31A and portions of each respective hinge 30 and 31 residing intermediate hinge 16 and opposing hinge portions 30A and 31A cooperate to define or otherwise bound opposing trusses 32 and 33.

Regarding FIG. 1, body 11 further includes an engagement element 35 carried by first extremity 20 and a complemental engagement element 38 carried by second extremity 21. In this specific example, engagement element 35 comprises a loop formed by a section 36 of body 11 bound generally by opposing hinge portions 30A and 31A, section 36 comprising a portion of first base section 12. Complemental engagement element 38 comprises a hook carried by a flap 39 coupled with second side section 15 via a hinge 40 extending transversely along body 11 substantially from first lateral extremity 11C to second lateral extremity 11D. Link all of the hinges of the present invention, hinge 40 is also preferably comprised of a living hinge.

Body 11 still further includes spaced-apart and substantially opposing first and second aspects or upstanding sidewalls 45 and 46 extending outwardly from first and second lateral extremities 11C and 11D, respectively, along substantially the entire length of second base section 14. Upstanding sidewall 45 terminates with an outer end 47 having a tongue 48 extending along substantially the entire length thereof. Furthermore, upstanding sidewall 46 terminates with an outer end 49 having a groove 50 extending along substantially the entire length thereof. Although not an essential feature, first and second upstanding sidewalls 45 and 46 may include an irregular outer surface 45A (FIG. 1) and 46A (FIG. 1) operative for facilitating gripping during use in an operative orientation of implement 10 to be discussed presently.

As shown in FIGS. 1, 2 and 3, the present invention further includes an engagement element 41 carried by and extending outwardly from first extremity 20. Turning to FIG. 6, engagement element 41 is detachably receivable into and through a channel 63 of a framework 64 of a conventional and well-known blade cartridge 62 so as to receive, carry and support blade cartridge 62. Blade cartridge 62 is of a conventional disposable variety commonly found in grocery stores, drug stores and supermarkets, further details of which will not be herein presently discussed.

Body 11 of implement 10 is foldable between an extended configuration shown in FIG. 1, a collapsed orientation shown in FIG. 4 and an operative orientation shown in FIG. 5. In the extended orientation, body 11 extends in a substantially planar orientation and element 41 resides in a substantially vertical upright orientation relative body 11. In the collapsed orientation, body 11 resides in a form of a substantially box-like receptacle. In the operative orientation, body 11 takes on a form of a handled body 60 that a user may grasp for use.

From, for instance, the extended orientation as shown in FIGS. 1, 2 and 3, first and second lateral extremities 11C and 11D may be folded inwardly toward inner surface 11A at hinges 30 and 31 to form the operative orientation of body 11 shown in FIG. 5. In the operative orientation, and although not shown in FIG. 5, tongue 48 of upstanding sidewall 45 mates with groove 50 of upstanding sidewall 46, tongue 48 and groove 50 cooperating together as an engagement assembly. To secure body 11 in place in the operative orientation, a user may apply a gentle compressive force, such as applied by hand, to upstanding sidewalls 45 and 46 to detachably engage tongue 48 with groove 50 to secure body 11 in the operative orientation in a form of a handled body 60 defined generally by a handle 70 having second extremity 21 and a head 61 at first extremity 20. From the operative orientation, a user may reverse the foregoing process to dispose body 11 in the substantially planar or extended orientation of FIG. 1.

When folded into the operative orientation, trusses 32 and 33 are drawn inwardly toward one another in converging directions generally indicated by the arrowed lines A and B in FIG. 3. As they are so drawn together, trusses 32 and 33 pull or otherwise draw section 36 inwardly toward inner surface 11A to an angled orientation positioning engagement element 41 at an angled orientation generally defining head 61 as shown in FIG. 5. So angled, one or more blades of blade cartridge 62, when mounted to engagement element 41, will be properly angled relative the handled body 60 for engagement and movement against a surface for effecting removal of hair. Furthermore, when in the operative orientation, trusses 32 and 33 of implement 10 exhibit a flexing tension at their free or outer edges that cooperate not only to orient and maintain blade cartridge 62 in a substantially angled orientation relative the handled body 60, but also permit blade cartridge 62 to pivot laterally during shaving activity permitting one or more of the blades carried by blade cartridge 62 to glide and adjust smoothly when drawn over and against a shaving surface.

With blade cartridge 62 attached to element 41 and thus carried by first extremity 20, and with implement 10 in the operative orientation, handle 70 may be grasp, such as by a human hand, for effecting movement and engagement of a blade or blades (not shown) of blade cartridge 62 for movement against a surface for removing hair therefrom. Implement 10 is thus operative as a hand-held razor suitable for allowing a user to shave and remove hair from his or her face, legs, etc.

From, for instance, the extended orientation of body 11, body 11 may be folded inwardly toward inner surface 11A at living hinges 16, 17 and 18 to form a receptacle generally designated at 80 in FIG. 4. Receptacle 80 is substantially box-like with first and second side sections 13 and 15 and first and second upstanding sidewalls 45 and 46 cooperating and generally defining the sides of receptacle 80, and first and second base sections 12 and 14 generally defining the top and bottom of receptacle 80. As shown in FIG. 4, receptacle 80 is closed. As a result, prior to folding body 11 into the collapsed orientation, a user may position selected items on inner surface 11A of body 11 to be captured and retained in receptacle 80 for storage. In this regard, a user may use receptacle 80 to store one or more spare blade cartridges and/or one or more packets of shaving cream, after-shave, etc. Furthermore, body 11 may be folded into the collapsed orientation without blade cartridge 62 attached to head 61 or with blade cartridge 62 attached to head 61 for containment within receptacle 80 for easy and convenient storage.

Although not specifically illustrated in the drawings, body 11 may be secured in the collapsed orientation as shown in FIG. 4 by engaging complemental engagement element 38 with engagement element 35, engagement element 35 and complemental engagement element 38 cooperating together as an engagement assembly. In this regard, and with body 11 in the collapsed orientation, complemental engagement element 38 may be forced and snap received into and through the loop comprising engagement element 35 to secure body 11 in the collapsed orientation. Those of ordinary skill will readily appreciate that the foregoing operation for folding and securing body 11 into the collapsed orientation need only be reversed to move body 11 into the extended orientation.

From the foregoing discussion, it will be appreciated that implement 10 is a highly useful item movable from a compacted orientation (FIG. 4) for easy transport in a bag, overnight kit or the like, to an operative position (FIG. 5) for allowing a user to detachably engage razor blade assembly 62 and subsequently employ implement 10 for a selected and desired shaving operation.

Figure 8:
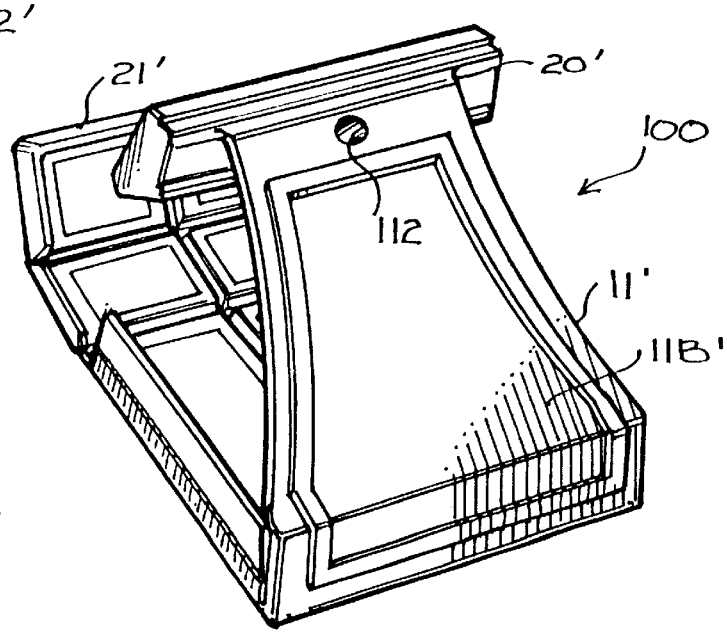
FIG. 8 is a perspective view of the implement of FIG. 7 shown as it would appear partially in a collapsed orientation.

Turning now to FIGS. 7 and 8, illustrated is an implement 100 constructed in accordance with an alternate embodiment of the present invention. Implement 100 is substantially identical in structure and function as implement 10. Therefore, the reference characters used to describe implement 10 will also be used to describe implement 100 to the extent of the common structural features. However, in the interests of clarity, common reference characters used to describe implement 100 will include a prime ("') symbol.

In this regard, and regarding FIG. 7, implement 100, like implement 10, generally includes body 11', inner surface 11A', outer surface 11B' (shown only in FIG. 8), first and second extremities 20' and 21', first and second lateral extremities 11C' and 11D', hinge 24' including first and second hinges 30' and 31' having opposing hinge portions 30A' and 31A', transverse hinges 16', 17' and 18', first and second base sections 12' and 14', first and second side sections 13' and 15', trusses 32' and 33', section 36', flap 39', hinge 40', first and second aspects or upstanding sidewalls 45' and 46' and blade cartridge 62' carried at first extremity 20'.

As an alternate engagement assembly for securing body 11' in the operative orientation in lieu of tongue 48 and groove 50 discussed in connection with implement 10, implement 100 includes a plurality of engagement elements 101 extending outwardly from inner surface 11A' adjacent first lateral extremity 11C' at spaced intervals along a length of body 11' substantially from first extremity 20' to second extremity 21'. Further included is an opposing plurality of complemental engagement elements 102 extending outwardly from inner surface 11A' adjacent second lateral extremity 11D at spaced intervals along a length of body 11' substantially from first extremity 20' to second extremity 21'. In this specific embodiment, each engagement element 101 comprises a pin 103, and each complemental engagement element 102 comprises a socket 104. To secure body 11' in the operative orientation, each pin 103 may be forced into an opposing socket 104 by applying compressive force to outer surface 11B' in opposition to each pin 103 and socket 104, each pin 103 being detachably and securingly engagable into a corresponding socket 104.

As clearly shown in FIG. 7, trusses 32' and 33' each define a first end directed toward transverse hinge 16' and a second end directed toward hinges 30A' and 31A', respectively. Truss 32' supports one of engagement elements 101 between its first and second ends and truss 33' supports one of complemental engagement elements 102 between its first and second ends. Trusses 32' and 33' are clearly hingeless between their respective first and second ends. Like implement 10, trusses 32' and 33' of implement 100 are drawn together in the operative orientation. It is clear from FIG. 7 that in the operative orientation, the one of engagement elements 101 of truss 32' is engaged to the one of complemental engagement elements 102 of truss 33' at a point between the first and second ends of each of trusses 32' and 33', which draws and holds trusses 32' and 331 inwardly toward one another between transverse hinge 16' and hinge portions 30A' and 31A'. In response to the engagement of engagement element 101 of truss 32' to complemental engagement element 102 of truss 33' and trusses 32' and 33' being so drawn and inwardly toward one another, trusses 32' and 33' are flexed. This flexed state of trusses 32' and 33', which was also explained in combination with implement 10, causes first extremity 20' to orient and maintain blade cartridge 62' in a substantially angled orientation relative to the handled body implement 100 forms in the operative orientation for engagement and movement against a surface for effecting removal of hair, and flex during shaving activity for allowing the blade of blade cartridge 62' to glide and adjust smoothly when drawn over and against a shaving surface.

Figure 9:
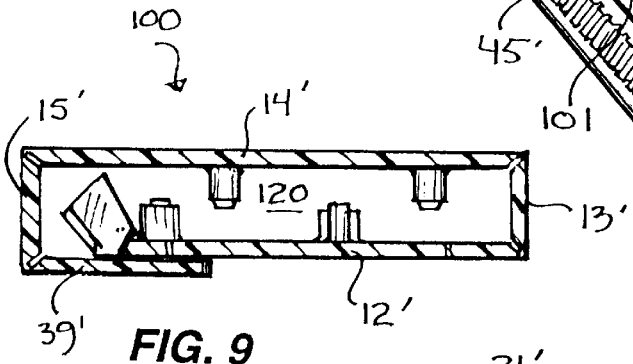
FIG. 9 illustrates a vertical sectional view of the implement of FIG. 7 shown as it would appear in a collapsed orientation.

As an alternate engagement assembly for securing body 11' in the collapsed orientation in lieu of the loop and hook comprising the engagement and complemental engagement elements 35 and 38 of implement 10, implement 100 includes a socket 110 extending outwardly from inner surface 11A' at section 36' adjacent first extremity 20' and a pin 111 extending outwardly from inner surface 11A' at flap 39' adjacent second extremity 21'. As shown in FIG. 8, socket 110 leads to an aperture 112 formed through portions of outer surface 11B' of body 11'. To secure body 11' in the collapsed orientation, pin 111 may be forced through aperture 112 and into socket 110 by applying compressive force to outer surface 11B' in opposition to pin 111, pin 111 being detachably and securingly engagable into socket 110. Regarding FIG. 9, and like implement 10, shown is a vertical sectional view of implement 100 as it would appear in the collapsed orientation with first and second base sections 12' and 14', first and second side sections 13' and 15', flap 39' and first and second aspects or upstanding sidewalls 45' and 46' (not shown in FIG. 9) cooperating to bound a chamber 120 containing blade cartridge 62' therein as it would appear carried at first extremity 20'.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An implement comprising:

(a) a body including:

(i) a hinge extending substantially from a first extremity of the body to a second extremity of the body, the hinge defining opposing hinge portions directed toward the first extremity, (ii) a plurality of transverse hinges positioned at spaced intervals intermediate the first and second extremities, each of the plurality of transverse hinges extending substantially from a first lateral extremity of the body to a second lateral extremity of the body, (iii) one of the plurality of transverse hinges, each of the opposing hinge portions and portions of the hinge intermediate the opposing hinge portions and the one of the plurality of transverse hinges cooperating to define opposing first and second hingeless trusses each having a first end directed toward the one of the plurality of transverse hinges and a second end directed toward one of the opposing hinge portions, and (iv) an engagement element carried by the first truss and a detachably engagable complemental engagement element carried by the second truss;

(b) a blade carried by the first extremity and engagable for movement against a surface for effecting hair removal;

(c) wherein the body is foldable:

(i) at the hinge between:

(1) an extended orientation of the body and, (2) an operative orientation in a form of a handled body with the blade exposed for engagement against a surface, such that in the operative orientation the engagement element of the first truss and the complemental engagement element of the second truss engage one another at a point between the first and second ends of each of the first and second trusses, which draws and holds the first and second trusses inwardly toward one another between the one of the plurality transverse hinges and the opposing hinge portions, and in response to the engagement of the engagement element to the complemental engagement element and the first and second trusses being drawn and held inwardly toward one another the first and second trusses are flexed, which causes the first extremity to a) orient and maintain the blade in a substantially angled orientation relative the handled body for engagement and movement against a surface for effecting removal of hair, and b) flex during shaving activity for allowing the blade to glide and adjust smoothly when drawn over and against a shaving surface; and (ii) at the plurality of transverse hinges between:

(1) a collapsed orientation of the body in a form of a receptacle, and (2) the extended orientation of the body; and (d) first means for securing the body in the collapsed orientation; and (e) second means for securing the body in the operative orientation.

2. The implement of claim 1, wherein each of the opposing hinge portions comprise opposing living hinge portions.

3. The implement of claim 1, wherein each one of the plurality of transverse hinges comprises a living hinge.

4. The implement of claim 1, wherein the first means for securing the body in the collapsed orientation includes:

an engagement element carried proximate one of the first and second extremities; and a detachably engagable complemental engagement element carried proximate the other one of the first and second extremities.

5. The implement of claim 4, wherein the engagement element includes a hook.

6. The implement of claim 5, wherein the complemental engagement element includes a loop.

7. The implement of claim 1, wherein the second means for securing the body in the operative orientation includes:

at least one engagement element carried proximate one of the first and second lateral extremities; and at least one detachably engagable complemental engagement element carried proximate the other one of the first and second lateral extremities.

8. The implement of claim 7, wherein the engagement element includes a tongue.

9. The implement of claim 8, wherein the complemental engagement element includes a groove.

10. The implement of claim 7, wherein the engagement element includes a pin.

11. The implement of claim 10, wherein the complemental engagement element includes a socket.

12. The implement of claim 1, wherein the plurality of transverse hinges divide the body into a plurality of base sections and a plurality of side sections.

13. The implement of claim 12, wherein the receptacle comprising the collapsed orientation of the body includes the plurality of base sections and the plurality of side sections cooperating together to form a receptacle.

* * * * *